US006429891B1

(12) United States Patent
Chee et al.

(10) Patent No.: US 6,429,891 B1
(45) Date of Patent: Aug. 6, 2002

(54) PRINTHEAD MOUNTING APPARATUS PROVIDING ADJUSTMENT TO EFFECT PRINTHEAD SKEW CORRECTION

(75) Inventors: Christopher Gregory Chee; Paul Douglas Horrall, both of Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/629,304

(22) Filed: Jul. 31, 2000

(51) Int. Cl.[7] ..... B41J 2/435
(52) U.S. Cl. ..... 347/263; 347/245
(58) Field of Search ..... 347/263, 138, 347/152, 245; 101/76; 358/300; 400/124.11, 124.14

(56) References Cited

U.S. PATENT DOCUMENTS 5,050,494 A * 9/1991 Goodwin ..... 101/76
5,374,993 A * 12/1994 Diehl et al. ..... 358/300
5,764,269 A 6/1998 Takeshita et al. ..... 347/233

* cited by examiner

*Primary Examiner*—Hai Pham
(74) *Attorney, Agent, or Firm*—Taylor & Aust, P.C.

(57) ABSTRACT

An imaging apparatus includes a machine frame unit having a plurality of mounting locations and a pivot location, a printhead base having a first end and a second end, and a first resilient elongate member having a first proximal end and a first distal end. A mounting tab is coupled to the first distal end of the first resilient elongate member, and is coupled to a first mounting location of the plurality of mounting locations of the machine frame unit. A pivot post, having an axis of rotation, pivotally couples a mounting plate to the pivot location of the machine frame unit. An adjustment device is coupled to the machine frame unit, the adjustment device having an engagement member for engaging at least one of the printhead base and the first resilient elongate member to effect a deflection of the first resilient elongate member and a corresponding movement of the printhead base. At least the first resilient elongate member is configured to define a virtual pivot axis for the movement of the printhead base when the mounting tab and the mounting plate are fixedly attached to the machine frame unit. A location of the virtual pivot axis substantially corresponds to a location of the axis of rotation of the pivot post.

29 Claims, 6 Drawing Sheets

PRINTHEAD MOUNTING APPARATUS PROVIDING ADJUSTMENT TO EFFECT PRINTHEAD SKEW CORRECTION

BACKGROUND OF THE INVENTION

1. Field of the Invention

The present invention relates to an imaging apparatus, and more particularly, to a printhead mounting apparatus providing adjustment to effect printhead skew correction in an imaging apparatus, such as a laser printer.

2. Description of the Related Art

In a typical in-line color electrophotographic imaging process, latent images are formed on a plurality of photosensitive drums, which are in turn each developed using a predetermined color of toner. Typically, these colors are black, magenta, cyan and yellow. The developed images are then transferred to either an intermediate transfer medium or directly to a sheet of media (such as paper) that travels past the photosensitive drums. The image in each color is created one line at a time, and the lines are oriented at right angles to the direction of travel of the media. The individually-generated images combine to form a full-color image. Thus, in a typical multi-color laser printer, the sheet of media receives color images generated at each of the four image developing stations.

It is recognized that in order for the multi-color laser printer to print accurately, the laser beams for all four colors must be in alignment, both in the scan direction (i.e., the direction the laser sweeps across the photoreceptive medium) and the process direction (feed direction of the print medium). However, providing proper alignment of even a single laser printhead in relation to the sheet of media in the process direction can be difficult. This problem is compounded with the addition of each printhead, since the plurality of printheads must be in registration so that the individual images generated by each printhead can be superimposed correctly when combined. During printer assembly an attempt is made to optically align the laser printheads both individually and collectively, but the ability to provide precise alignment is limited by several factors, including component manufacturing tolerances. In addition, it is possible for a precisely aligned printhead to drift out of alignment over time due to component aging and ambient environmental factors, such as temperature. Skew is one such alignment parameter that can be corrected by mechanical rotation of the printhead relative to a pivot point located in the printer mounting frame. Skew is the slope of a least squares fit straight line through all of the laser spots across a scan line.

It is known that one can use one of a variety of sliding or pivoting mechanisms to mount a printhead to a printer frame and to provide adjustment of the position of a printhead in an adjustment direction to correct printhead skew. However, such sliding mechanisms are difficult to control when attempting to make small adjustments necessitating movement of the slide mechanism over a very short distance. In attempting small adjustments, there is a likelihood that the mechanism will exhibit the phenomenon know as "stick-slip", or frictional hysteresis, which makes repeatability uncertain. For example, an executed command to move the slide mechanism a certain distance at one time may not be repeatable in producing the same amount of motion at another time. In addition, when the fasteners mounting the printhead to the mounting frame are tightened, unwanted rotation can produce an error in skew registration.

What is needed in the art is an apparatus that can consistently provide precise and repeatable printhead skew adjustment in an imaging apparatus to compensate for printhead alignment errors due to printhead skew.

SUMMARY OF THE INVENTION

The present invention provides an apparatus that can consistently provide precise and repeatable printhead skew adjustment in an imaging apparatus to compensate for printhead alignment errors due to printhead skew, and in addition, provides compensation for thermal dimensional variations of the printhead.

One aspect of the invention relates to an imaging apparatus including a machine frame unit having a plurality of mounting locations and a pivot location, a printhead base having a first end and a second end, and a first resilient elongate member having a first proximal end and a first distal end. The first proximal end is attached to the first end of the printhead base. A mounting tab is coupled to the first distal end of the first resilient elongate member. The first mounting tab is coupled to a first mounting location of the plurality of mounting locations of the machine frame unit. A mounting plate is coupled to the second end of the base. The mounting plate is coupled to at least a second mounting location of the plurality of mounting locations of the machine frame unit. A pivot post, having an axis of rotation, pivotally couples the mounting plate to the pivot location of the machine frame unit. An adjustment device is coupled to the machine frame unit, the adjustment device having an engagement member for engaging at least one rigid feature of the printhead base and the first resilient elongate member to effect a deflection of the first resilient elongate member and a corresponding movement of the printhead base. At least the first resilient elongate member is configured to allow for translation which in turn allows the printhead base to move with respect to a virtual pivot axis without significantly distorting optical mounting relationships within the housing when the mounting tab and the mounting plate are fixedly attached to the machine frame unit. A location of the virtual pivot axis substantially corresponds to a location of the axis of rotation of the pivot post.

In another aspect of the invention, a method is provided for correcting printhead skew in an apparatus having a machine frame unit to which a printhead having a printhead housing is mounted. The method includes the steps of: defining a desired scan path for the printhead; identifying an actual scan path of the printhead; determining an amount of skew between the desired scan path and the actual scan path; providing an eccentric shaft which engages the machine frame unit and the printhead housing rotating the eccentric shaft to effect an initial positioning of the printhead housing with respect to the machine frame unit; providing a plurality of fasteners to fixedly attach the printhead housing to the machine frame unit following the initial positioning; and providing a fine adjustment mechanism to effect a rotation of the printhead housing about a virtual pivot axis to provide a final positioning of the printhead after the printhead housing is fixedly attached to the machine frame unit.

One advantage of the present invention is that precise incremental changes in the orientation of the printhead can be easily effected.

Another advantage of the present invention is that it allows for thermal dimensional variations of the printhead, and in particular, the length of the printhead housing structure, without inducing a torque on the housing that would affect skew relationships.

Still another advantage is that the printhead orientation fine adjustment mechanism is not adversely affected by frictional hysteresis, or by tightening mounting fasteners.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
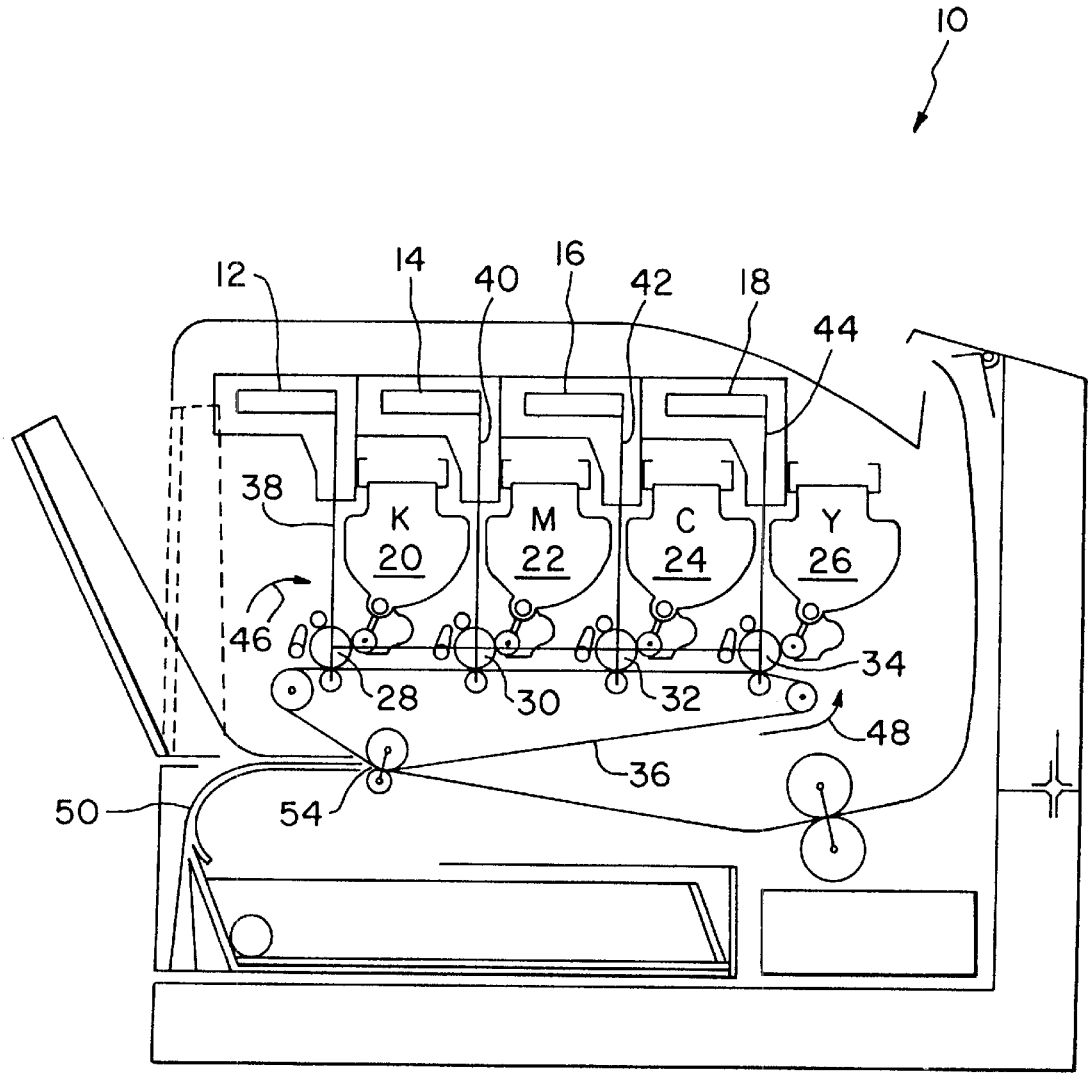
FIG. 1 is a side view in schematic of a multicolor laser printer embodying the present invention.

Referring now to the drawings and, more particularly, to FIG. 1, there is shown one embodiment of a multicolor laser printer 10 including laser printheads 12, 14, 16, 18, a black toner cartridge 20, a magenta toner cartridge 22, a cyan toner cartridge 24, a yellow toner cartridge 26, photoconductive drums 28, 30, 32, 34, and an intermediate transfer member belt 36.

Each of laser printheads 12, 14, 16 and 18 scans a respective laser beam 38, 40, 42, 44 in a scan direction, perpendicular to the plane of FIG. 1, across a respective one of photoconductive drums 28, 30, 32 and 34. Each of photoconductive drums 28, 30, 32 and 34 is negatively charged to approximately −900 volts and is subsequently discharged to a level of approximately −200 volts in the areas of its peripheral surface that are impinged by a respective one of laser beams 38, 40, 42 and 44 to form a latent image thereon made up of a plurality of dots, or pets. During each scan of a laser beam across a photoconductive drum, each of photoconductive drums 28, 30, 32 and 34 is continuously rotated, clockwise in the embodiment shown, in a process direction indicated by direction arrow 46. The scanning of laser beams 38, 40, 42 and 44 across the peripheral surfaces of the photoconductive drums is cyclically repeated, thereby discharging the areas of the peripheral surfaces on which the laser beams impinge.

The toner in each of toner cartridges 20, 22, 24 and 26 is negatively charged to approximately −600 volts. Thus, when the toner from cartridges 20, 22, 24 and 26 is brought into contact with a respective one of photoconductive drums 28, 30, 32 and 34, the toner is attracted to and adheres to the portions of the peripheral surfaces of the drums that have been discharged to −200 volts by the laser beams. As belt 36 rotates in the direction indicated by arrow 48, the toner from each of drums 28, 30, 32 and 34 is transferred to the outside surface of belt 36. As a print medium, such as paper, travels along path 50, the toner is transferred to the surface of the print medium in nip 54. If it is determined that one or more of printheads 12, 14, 16, 18 are identified as being skewed, the printhead orientation can be adjusted using the printhead skew adjustment apparatus of the invention, as is more fully described below.

Each of printheads 12, 14, 16, 18 is substantially identical in structure. Accordingly, to simplify the discussion and for ease of understanding the invention, only the structure of printhead 12 will be described in detail below in relation to FIGS. 2–6B. However, it is to be understood that the discussion that follows with respect to printhead 12 also applies to each of printheads 14, 16, and 18.

Figure 2:
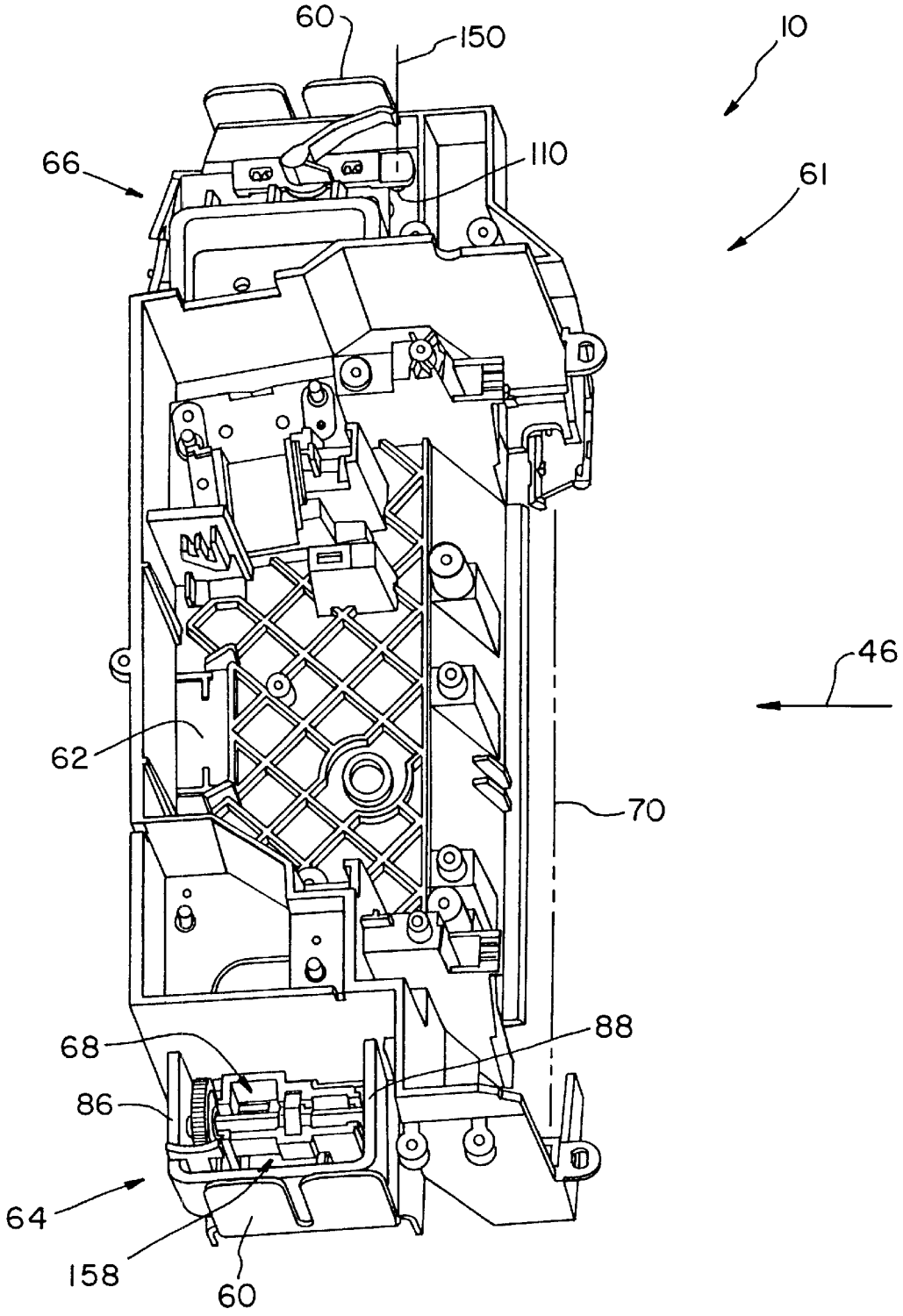
FIG. 2 is a top perspective view of a printhead housing of the invention attached to a machine frame.

FIG. 2 shows a portion of laser printer 10 including a machine frame unit 60 and a printhead housing 61. Printhead housing 61 includes a printhead base 62, a first resilient elongate unit 64, and a second resilient elongate unit 66. Also shown is a fine adjustment mechanism 68. In a preferred embodiment of the invention, first resilient elongate unit 64 and second resilient elongate unit 66 are formed integral with printhead base 62.

Printhead 12 includes a laser beam generator and associated optics (not shown), including a multi-faceted scanning mirror, and control electronics (not shown) mounted to printhead base 62 for providing scanning control of the laser beam in a direction of scanning along the laser beam scan path depicted by line 70.

Figure 3:
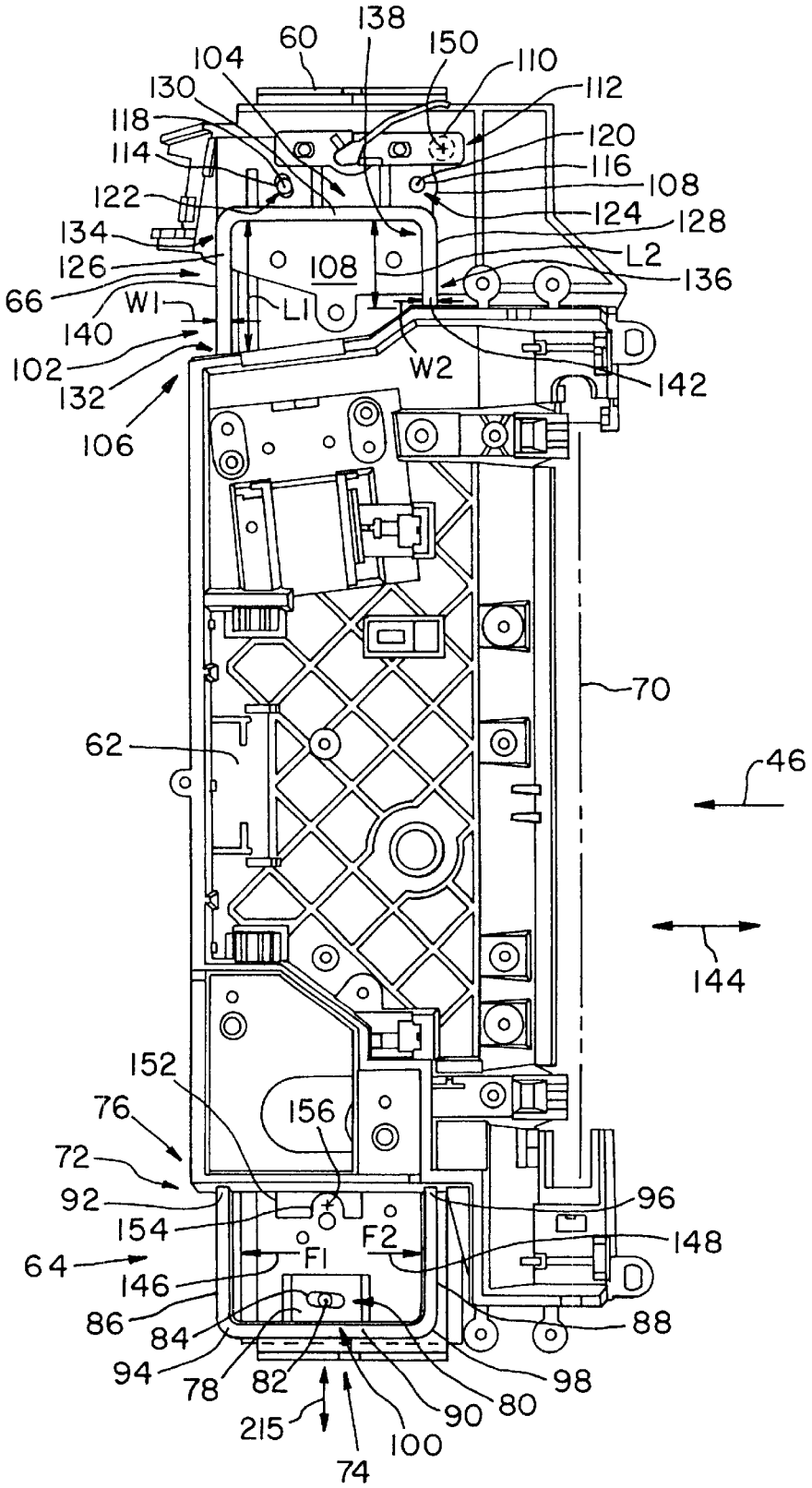
FIG. 3 is a top view of the printhead housing of FIG. 2, with the fine adjustment mechanism of the invention removed.

As shown in FIG. 3, first resilient elongate unit 64 has a first proximal end 72 and a first distal end 74. First proximal end 72 is attached to a first end 76 of printhead base 62. A mounting tab 78 is coupled to first distal end 74 of first resilient elongate unit 64. Mounting tab 78 is fixedly coupled to a first mounting location 80 of machine frame unit 60 via a fastener 82. Mounting tab 78 includes a slotted aperture 84 for receiving fastener 82, which in turn provides for the adjustable rigid attachment of resilient elongate unit 64 to machine frame unit 60.

First resilient elongate unit 64 includes a first resilient elongate member 86, a second resilient elongate member 88 and a third resilient elongate member 90. First resilient elongate member 86 has a proximal end 92 and a distal end 94, wherein proximal end 92 is attached to first end 76 of printhead base 62. Second resilient elongate member 88 has a proximal end 96 and a distal end 98, wherein proximal end 96 also is attached to first end 76 of printhead base 62, but at a location spaced apart from proximal end 92 of first resilient elongate member 86. Third resilient elongate member 90 is attached to and bridges between distal end 94 of first elongate member 86 and distal end 98 of second elongate member 88. As shown in FIG. 3, first mounting tab 78 is connected to an intermediate portion 100 of third resilient elongate member 90, and located to be symmetrical with respect to resilient elongate unit 64.

Second resilient elongate unit 66 has a proximal end 102 and a distal end 104. Proximal end 102 is attached to a second end 106 of printhead base 62. A mounting plate 108 is connected to distal end 104 of second resilient elongate unit 66.

Referring to FIGS. 2 and 3, a pivot post 110 (shown by phantom lines in FIG. 3), preferably integral with mounting plate 108, pivotally couples mounting plate 108 to a pivot location 112 (shown by a diamond shaped dotted line) associated with machine frame unit 60. Pivot location 112 preferably is a hole sized to pivotally accommodate pivot post 110. The hole of pivot location 112 may be formed directly in a main frame portion of machine frame unit 60, or may be formed in an intermediate plate fixedly attached to the main frame portion. Also, while the hole of pivot location 112 may be round, the hole most preferably has a polygonal shape, such as a triangular or square shape, to eliminate clearance due to parts tolerances between pivot post 110 and machine frame unit 60.

Mounting plate 108 also includes a pair of slotted apertures 114 and 116 through which fasteners 118 and 120, respectively, pass to engage mounting locations 122 and 124, respectively, of machine frame unit 60. When tightened, fasteners 118, 120 fixedly attach mounting plate 108 to machine frame unit 60.

Second resilient elongate unit 66 includes a fourth resilient elongate member 126, a fifth resilient elongate member 128 and a sixth elongate member 130. Fourth resilient elongate member 126 has a proximal end 132 and a distal end 134, wherein proximal end 132 is attached to second end 106 of printhead base 62. Fifth resilient elongate member 128 has a proximal end 136 and a distal end 138, wherein proximal end 136 also is attached to first end 106 of printhead base 62, but at a location spaced apart from proximal end 132 of fourth resilient elongate member 126. Sixth elongate member 130 is attached to and bridges between distal end 134 of fourth elongate member 126 and distal end 138 of fifth elongate member 128.

As shown in FIG. 3, mounting plate 108 is attached to an under side of elongate members, 126, 128 and 130 to effectively form a rigid structure near distal end 104 of second resilient elongate unit 66. However, since mounting plate 108 does not extend to second end 106 of printhead base 62, elongate unit 66 remains somewhat resilient. Thus, the amount of flexure in resilient elongate unit 66 is dependent upon the lengths L1 and L2, and widths W, and W2, of the resilient portions 140 and 142, respectively of fourth and fifth resilient elongate members 126 and 128, respectively. The length of the resilient portions 140, 142 is significantly less than the length of resilient elongate members 86, 88. Accordingly, the amount of flexure that is permitted within second resilient elongate unit 64 in the directions depicted generally by arrow 144 is significantly less than the amount of flexure permitted within first resilient elongate unit 64. Also, the length L1 of resilient portion 140 is significantly greater than the length L2 of resilient portion 142. Therefore, with the configuration described above, once fasteners 82, 118, 120 have been tightened, any force (F1, F2) in the directions depicted by arrows 146 and 148, respectively, acting on printhead base 62 and/or first resilient elongate unit 64 will result in a pivoting of printhead base 62 at a virtual pivot axis 150 substantially corresponding to an axis of pivot post 110.

Also, as shown in FIG. 3, attached to and extending from first end 76 of printhead base 62 is a coarse adjustment tab 152. Coarse adjustment tab 152 has a semi-circle shaped perimetrical surface 154 which defines a void having an axis 156 and a diameter D1 (see FIG. 6B).

Figure 4:
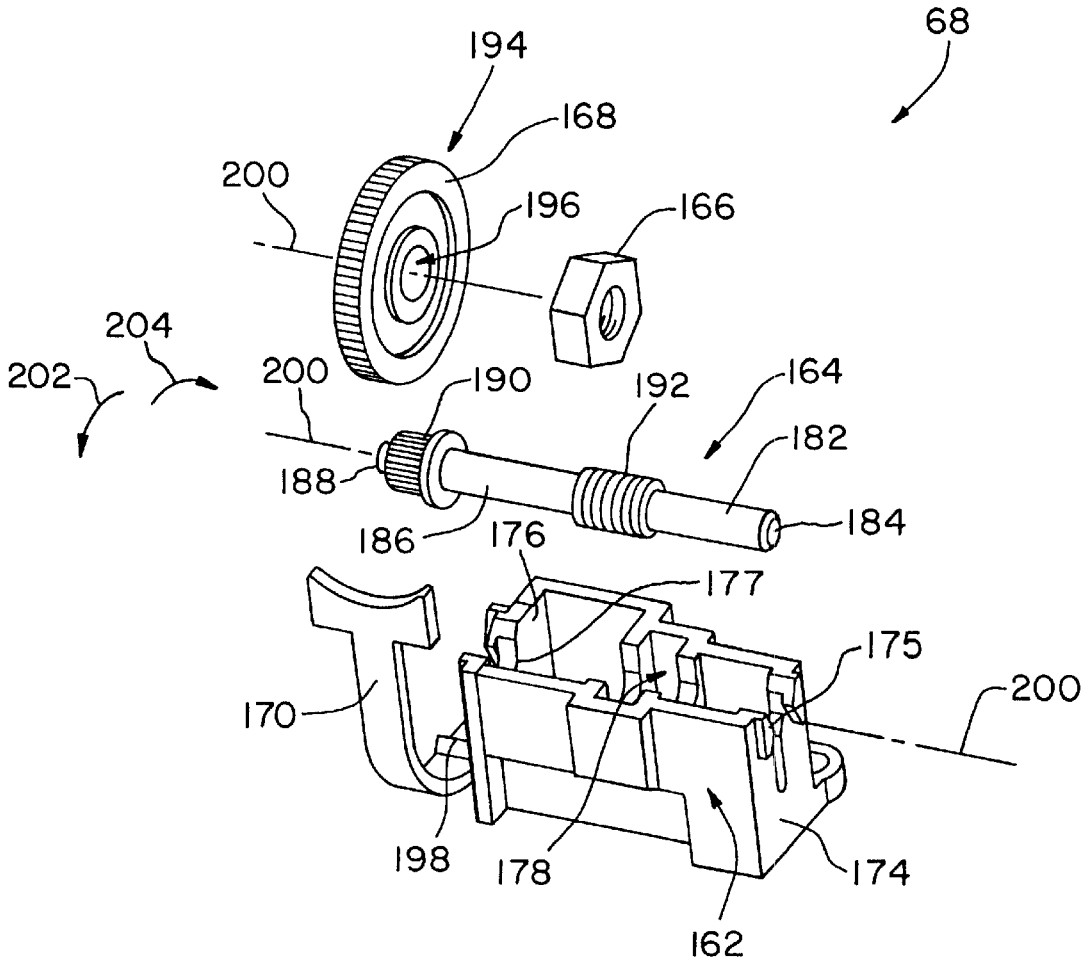
FIG. 4 is an exploded view of the fine adjustment mechanism shown in FIG. 2.

Referring again to FIG. 2, resilient elongate unit 64 defines an open interior 158 into which fine adjustment mechanism 68 is inserted for direct attachment to machine frame unit 60. Referring to FIG. 4, fine adjustment mechanism 68 is shown in exploded form to include an adjustment frame 162, engagement shaft 164, a nut 166, a wheel (or gear) 168 and a detention arm 170.

Adjustment frame 162 includes a first end wall 174, a second end wall 176 and a central partition section 178. Engagement shaft 164 includes a first end portion 182 having a first engagement end 184, a second end portion 186 having a second engagement end 188, a knurled portion 190 and a central threaded portion 192. Each of end walls 174, 176 include a respective void 175, 177 shaped to secure for rotation therein end portions 182, 186, respectively, of engagement shaft 164. Wheel 168 includes a plurality of teeth 194 located around the periphery of wheel 168 and an axial hole 196. Detention arm 170 includes a detention protrusion 198.

The assembly of fine adjustment mechanism 68 is as follows. Nut 166 (having internal threads) is threaded onto central portion 192 (having corresponding external threads). Wheel 168 is pressed onto knurled portion 190 through axial hole 196. This shaft assembly is then inserted into adjustment frame 162 by snapping end portions 182, 186 into the voids 175, 177 of end walls 174, 176, respectively. At this time, nut 166 is received in central partition section 178. Central partition section 178 engages at least two opposing face surfaces of nut 166 to prevent rotation of nut 166 within adjustment frame 162.

Once fine adjustment mechanism 68 is assembled, detention protrusion 198 engages the valley between two adjacent teeth of the plurality of teeth 194 to inhibit rotation of engagement shaft 164. To rotate engagement shaft 164, detention arm 170 is deflected to at least partially disengage detention protrusion 198 from the plurality of teeth 194 of wheel 168. Thereafter, wheel 168 may be rotated in either direction about axis 200, as depicted by direction arrows 202, 204.

During rotation, one of engagement ends 184, 188 of engagement shaft 164 will be projected and the other will be retracted with respect to adjustment frame 162 due to the linear offset of engagement shaft 164 along axis 200 caused by the rotation of engagement shaft 164 within stationary nut 166. Whether an engagement end will be projected or retracted will be dependent upon whether the threads of nut 166 and central portion 192 are right-hand or left-hand threads, and upon the direction of rotation 202, 204 of wheel 168. The amount of linear displacement of engagement shaft 164 will be dependent upon the thread pitch of nut 166 and central portion 192, the circumference of central portion 192 and the rotational angular displacement of wheel 168 about axis 200. Also, the smaller the pitch between two adjacent teeth of the plurality of teeth 194 on the outer periphery of wheel 168, the finer the increment of rotation that can be maintained by detention protrusion 198.

The installation of printhead 12 onto machine frame unit 60 occurs as follows, with reference to FIGS. 2 and 3. Printhead base 62 is positioned over machine frame unit 60 such that pivot post 110 engages the hole of pivot location 112. Thereafter, slotted apertures 84, 114 and 116 are aligned with mounting locations 80, 122, and 124, respectively. Fasteners 82, 118 and 120 are then inserted through slotted apertures 84, 114 and 116 and loosely secured into machine frame unit 60 at mounting locations 80, 122, and 124, respectively. At this time, printhead 12 is ready for coarse adjustment of the laser beam scan path 70 with respect to the process direction 46.

Figure 5:
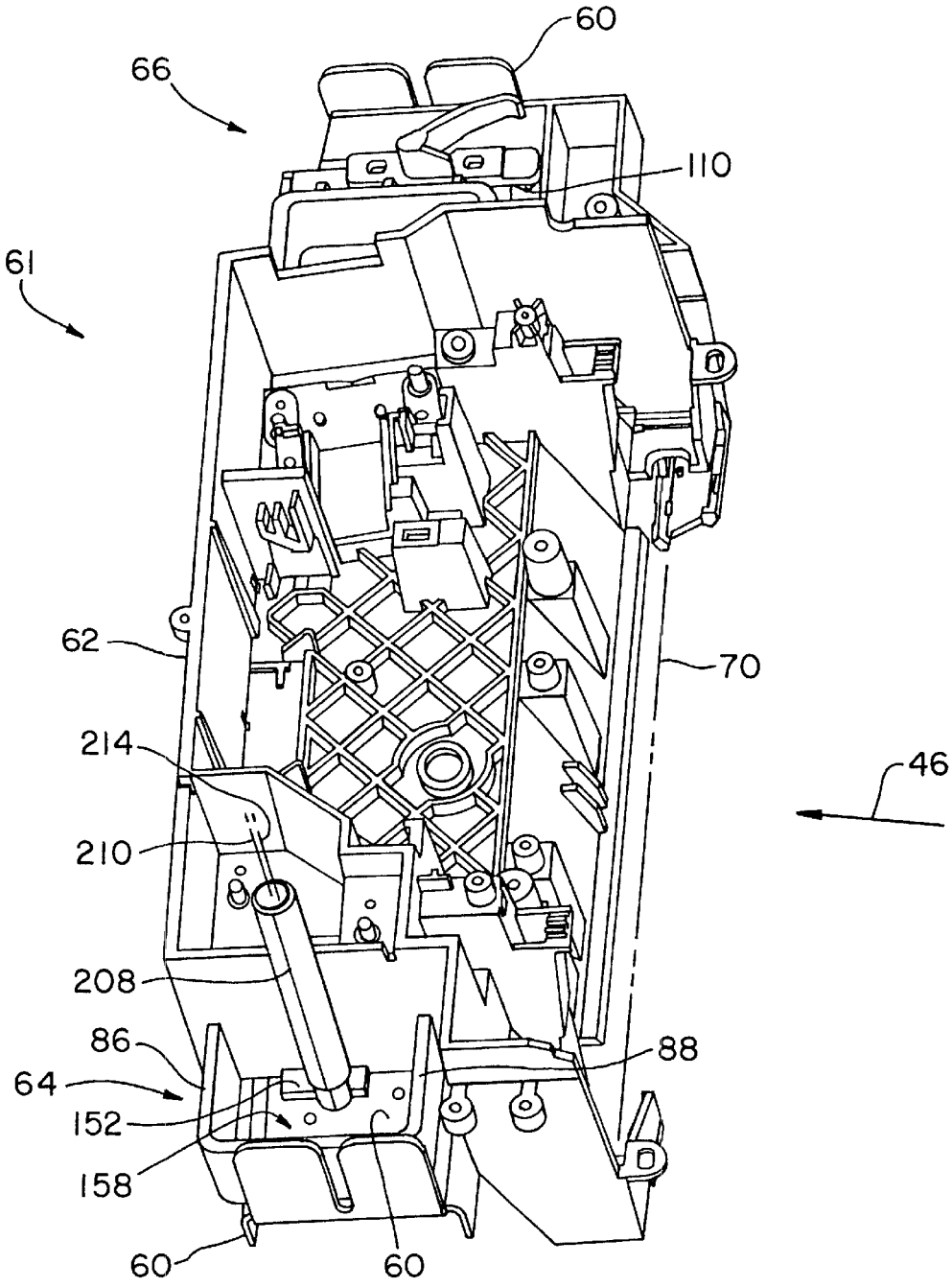
FIG. 5 is a perspective view of the printhead housing shown in FIG. 3, with a coarse adjustment tool installed.
Figure 6A:
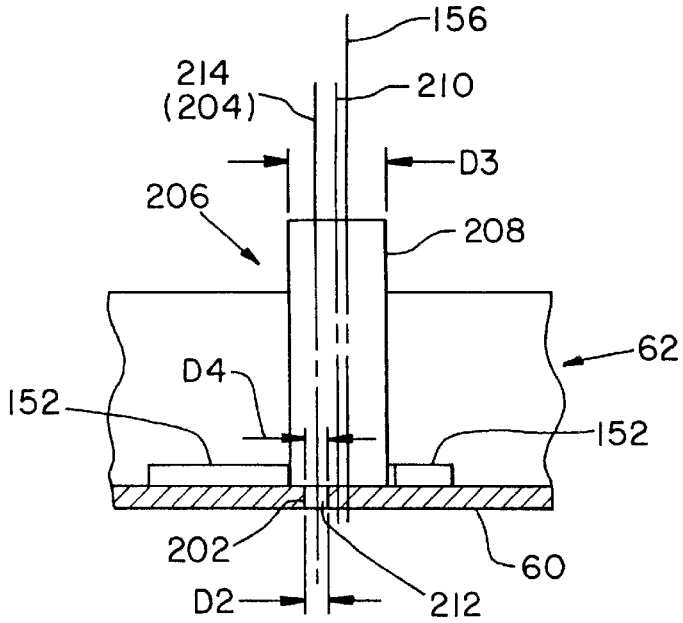
FIG. 6A is a broken-out end sectional view of the printhead base and coarse adjustment tool depicted in FIG. 5.
Figure 6B:
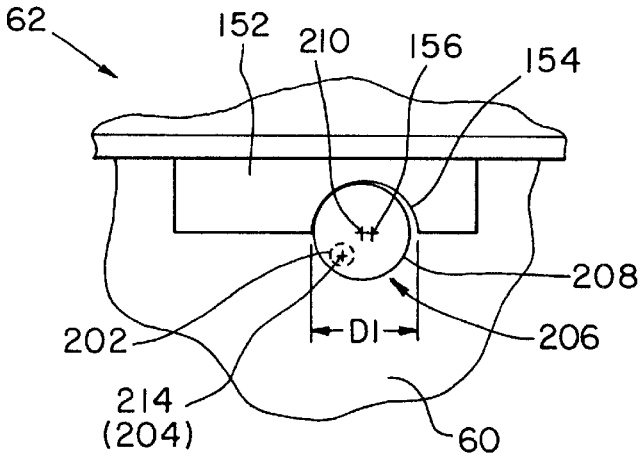
FIG. 6B is a broken-out top view of printhead base and coarse adjustment tool depicted in FIG. 6A.

Referring to FIGS. 5, 6A and 6B, coarse adjustment of the position of printhead housing 61 of printhead 12 is achieved as follows. Machine frame unit 60 includes a hole 202 (FIG. 6B) having an axis 204 and a diameter D2. Axis 204 is located to be offset from axis 156 of semi-circle shaped perimetrical surface 154 of coarse adjustment tab 152. A coarse adjustment tool 206 in the form of an eccentric shaft is used to controllably manipulate the position of printhead base 62 with respect to machine frame unit 60.

Coarse adjustment tool 206 includes a first cylindrical rod portion 208 having an axis 210 and a second cylindrical rod portion 212 having an axis 214., First cylindrical rod portion 208 has a diameter D3 sized to slideably engage semi-circle shaped perimetrical surface 154 of coarse adjustment tab 152. Second cylindrical rod portion 212 has a diameter D4. Diameter D4 of cylindrical rod portion 212 is sized to be slightly less than the diameter D2 of hole 202 so as to pivotally engage hole 202. Axis 210 is offset from axis 214, thus accounting for the eccentricity of coarse adjustment tool 206. Once rod portion 212 is inserted into hole 202, the position of printhead base 62 with respect to machine frame unit 60 is manipulated by rotating coarse adjustment tool 206 around axis 214.

During coarse adjustment, slotted apertures 84, 114 and 116 permit a pivotal rotation of printhead base 62 about the pivot axis of pivot post 110 without any resulting deflection of resilient elongate members 86, 88, or resilient portions 140, 142. Once printhead 12 is positioned at the desired initial position, fasteners 82, 118 and 120 are tightened to fixedly, i.e., rigidly, attach printhead housing 61 to machine frame unit 60, and coarse adjustment tool 206 is removed. Unfortunately, the tightening of fasteners 82, 118 and 120 may introduce a skew of ±40 to 60 microns.

To achieve final assembly alignment of laser beam scan path 70 of printhead 12 in relation to the process direction 46 of printer 10, fine adjustment mechanism 68 is inserted into open interior 158 of resilient elongate unit 64. Thereafter, fine adjustment mechanism 68 is directly attached, preferably at three locations, to machine frame unit 60. Once assembled, engagement ends 188, 184 (FIG. 4) are positioned for engagement with either of resilient elongate members 86, 88, respectively. By rotating wheel 168, a linear displacement of engagement shaft 164 is effected along axis 200.

Referring again to FIGS. 2 and 4, prior to effecting fine adjustment, the orientation of the actual scan line 70 of printhead 12 is measured and compared to an ideal scan line orientation to determine an amount of printhead skew. The desired target for the amount of skew is ±15 microns. Depending upon the orientation of the measured skew, wheel 168 is rotated to project one of engagement ends 184, 186 into a corresponding one of resilient elongate members 86, 88. For example, to effect a rotation of printhead base 62 around virtual pivot axis 150 in the clockwise direction (with respect to the depiction of FIG. 2), wheel 168 is rotated to cause engagement end 188 of engagement shaft 164 to engage and apply a force F1 to resilient elongate member 86, which in turn results in a deflection of resilient elongate members 86, 88 and resilient portions 140, 142 of resilient elongate members 126, 128 (see FIG. 3). Likewise, to effect a rotation of printhead base 62 around virtual pivot axis 150 in the counter-clockwise direction (with respect to the depiction of FIG. 2), wheel 168 is rotated to cause engagement end 184 of engagement shaft 164 to engage and apply a force F2 to resilient elongate member 88, which in turn results in a deflection of resilient elongate members 86, 88 and resilient portions 140, 142 of resilient elongate members 126, 128. Such deflections as described above result in the convex bowing of resilient elongate members 86, 88 with respect to the direction of rotation around virtual pivot axis 150.

Preferably, elongate beam members 86, 88, 90, 126, 128 have a substantially rectangular cross-section and are designed to be flexible only in a direction substantially normal to their respective thin dimension. Thus, when secured to machine frame unit 60, elongate members 86, 88, 90, 126, 128, 130 permit rigid mounting of printhead 12 to machine frame unit 60, while permitting printhead housing 61 to pivot around virtual pivot axis 150 when acted upon by fine adjustment mechanism 68. Preferably, printhead housing 61 is made of the material NORYL 4025 so as to have a thermal coefficient of expansion which is low and nearly equal in both the flow and cross-flow directions to minimizing twist due to thermal load. Since thermal expansion of printhead 12 is more pronounced in its long dimension, printhead base 62 and resilient elongate units 64 and 66 are configured to channel thermal expansion/retraction in the directions toward/from mounting tab 78 for deflective absorption of this thermal movement by resilient elongate member 90 in the directions depicted by the arrows of line 215, which is substantially normal to the thin dimension of resilient elongate member 90. Thus, the configuration of printhead housing 61, and in particular the symmetry of resilient elongate unit 64, permits the even absorption of thermal variations by resilient elongate member 90 without introducing torque that would affect skew of printhead 12.

The present invention has been described herein as being used in conjunction with a laser printer. However, it is to be understood that it is possible for the present invention to be adapted for use in conjunction with other types of electrophotographic imaging apparatus, such as copying machines.

While this invention has been described as having a preferred design, the present invention can be further modified within the spirit and scope of this disclosure. This application is therefore intended to cover any variations, uses, or adaptions of the invention using its general principles. Further, this application is intended to cover such departures from the present disclosure as come within known or customary practice in the art to which this invention pertains and which falls within the limits of the appended claims.

What is claimed is:

1. An imaging apparatus, comprising:

a machine frame unit having a plurality of mounting locations and a pivot location;

a printhead base having a first end and a second end;

a first resilient elongate member having a first proximal end and a first distal end, wherein said first proximal end is attached to said first end of said printhead base;

a mounting tab coupled to said first distal end of said first resilient elongate member, said mounting tab being coupled to a first mounting location of said plurality of mounting locations of said machine frame unit;

a mounting plate coupled to said second end of said base, said mounting plate being coupled to at least a second mounting location of said plurality of mounting locations of said machine frame unit;

a pivot post pivotally coupling said mounting plate to said pivot location of said machine frame unit, said pivot post having an axis of rotation; and an adjustment device coupled to said machine frame unit, said adjustment device having an engagement member for engaging at least one of said printhead base and said first resilient elongate member to effect a deflection of said first resilient elongate member and a corresponding movement of said printhead base, wherein at least said first resilient elongate member is configured to define a virtual pivot axis for said movement of said printhead base when said mounting tab and said mounting plate are fixedly attached to said machine frame unit, and wherein a location of said virtual pivot axis substantially corresponds to a location of said axis of rotation of said pivot post.

2. The imaging apparatus of claim 1, wherein said mounting tab includes a slotted aperture for receiving a fastener, said slotted aperture permitting a positioning of said printhead base about said pivot post without a resulting deflection of said first resilient elongate member when said first mounting tab and said mounting plate are not fixedly attached to said machine frame unit.

3. The imaging apparatus of claim 1, further comprising a second resilient elongate member having a second proximal end and a second distal end, wherein said second proximal end is attached to said first end of said printhead base at a location spaced apart from said first proximal end of said first resilient elongate member and wherein said second distal end is coupled to said first mounting tab, said engagement member being interposed between said first resilient elongate member and said second resilient elongate member, said engagement member being positioned for engaging at least one of said first resilient elongate member and said second resilient elongate member.

4. The imaging apparatus of claim 3, wherein said adjustment device comprises:

a device frame having a threaded bore, wherein a centerline of said threaded bore extends toward each of said first resilient elongate member and said second resilient elongate member;

a threaded shaft for cooperative rotatable engagement with said threaded bore, said threaded shaft including a first engagement end and a second engagement end, said threaded shaft being interposed between said first resilient elongate member and said second resilient elongate member; and an actuator located between said first engagement end and a second engagement end for effecting a rotation of said threaded shaft.

5. The imaging apparatus of claim 4, wherein an engagement of said first engagement end of said threaded shaft with said first elongate member causes a deflection of said first elongate member resulting in a pivoting of said printhead base about said virtual pivot axis in a first direction, and wherein an engagement of said second engagement end of said threaded shaft with said second elongate member causes a deflection of said second elongate member resulting in a pivoting of said printhead base about said virtual pivot axis in a second direction different than said first direction.

6. The imaging apparatus of claim 4, wherein said actuator comprises a rotary wheel having a plurality of teeth located around a periphery of said wheel.

7. The imaging apparatus of claim 6, wherein said adjustment device further comprises a flexible arm connected to said device frame, said flexible arm including a detent protrusion which engages a valley between a pair of teeth of said plurality of teeth of said wheel to inhibit rotation of said threaded shaft, and wherein a deflection of said flexible arm disengages said detent protrusion from said valley to permit rotation of said threaded shaft.

8. The imaging apparatus of claim 1, further comprising:

a coarse adjustment tab extending from said printhead base, said coarse adjustment tab having a semi-circle shaped perimetrical surface defining a void having a first diameter and a first axis; and a first hole formed in said machine frame unit having a second diameter and a second axis, said second axis being offset from said first axis, wherein said semicircle shaped perimetrical surface and said first hole are positional to accommodate an eccentric shaft coarse adjustment tool.

9. The imaging apparatus of claim 1, further comprising:

a second resilient elongate member having a second proximal end and a second distal end, wherein said second proximal end is attached to said first end of said printhead base at a location spaced apart from said first proximal end of said first resilient elongate member; and a third resilient elongate member attached to and bridging between said first distal end of said first resilient elongate member and said second distal end of said second resilient elongate member, wherein said mounting tab is connected to an intermediate portion of said third resilient elongate member.

10. The imaging apparatus of claim 9, wherein said adjustment device comprises:

a device frame having a threaded bore, wherein a centerline of said threaded bore extends toward each of said first resilient elongate member and said second resilient elongate member;

a threaded shaft for cooperative rotatable engagement with said threaded bore, said threaded shaft including a first engagement end and a second engagement end, said threaded shaft being interposed between said first resilient elongate member and said second resilient elongate member; and an actuator located between said first engagement end and a second engagement end for effecting a rotation of said threaded shaft.

11. The imaging apparatus of claim 1, wherein said pivot post is integral with said mounting plate.

12. An apparatus for correcting printhead skew in an imaging apparatus, said imaging apparatus including a machine frame unit having a plurality of mounting locations with a corresponding plurality of mounting fasteners and a pivot location, said apparatus comprising:

a printhead base for mounting a laser, said printhead base having a first end and a second end;

a first resilient elongate unit having a first proximal end and a first distal end, wherein said first proximal end is attached to said first end of said printhead base, and having a mounting tab coupled to said first distal end, said mounting tab being adapted for adjustable rigid attachment to a first mounting location of said plurality of mounting locations of said machine frame unit;

a second resilient elongate unit having a second proximal end and a second distal end, wherein said second proximal end is attached to said second end of said printhead base;

a mounting plate connected to said second resilient elongate unit, said mounting plate being adapted for adjustable rigid attachment to at least a second mounting location of said plurality of mounting locations of said machine frame unit;

a pivot post adapted for pivotally coupling said mounting plate to said pivot location of said machine frame unit; and an adjustment device adapted for connection to said machine frame unit, said adjustment device having an engagement member for engaging said first resilient elongate unit at least one location to effect a deflection of said first resilient elongate unit and said second resilient elongate unit when said mounting tab and said mounting plate are rigidly attached to said machine frame unit.

13. The apparatus of claim 12, wherein a relative stiffness of said second resilient elongate unit is greater than the stiffness of said first elongate unit.

14. The apparatus of claim 12, wherein said first resilient elongate unit comprises:

a first resilient elongate member;

a second resilient elongate member spaced apart from said first resilient elongate member; and a third resilient elongate member connected between said first resilient elongate member and said second resilient elongate member.

15. The apparatus of claim 14, wherein said mounting tab is connected to a central portion of said third resilient elongate member.

16. The apparatus of claim 14, wherein said adjustment device further comprises an engagement member interposed between said first resilient elongate member and said second resilient elongate member for effecting a deflection of said first resilient elongate member and said second resilient elongate member.

17. The apparatus of claim 14, wherein said adjustment device comprises:

a device frame having a threaded bore, wherein a centerline of said threaded bore extends toward each of said first resilient elongate member and said second resilient elongate member;

a threaded shaft for cooperative rotatable engagement with said threaded bore, said threaded shaft including a first engagement end and a second engagement end, said threaded shaft being interposed between said first resilient elongate member and said second resilient elongate member; and an actuator located between said first engagement end and a second engagement end for effecting a rotation of said threaded shaft.

18. The apparatus of claim 17, wherein an engagement of said first engagement end of said threaded shaft with said first elongate member causes a deflection of said first elongate member resulting in a pivoting of said printhead base about a virtual pivot axis in a first direction, and wherein an engagement of said second engagement end of said threaded shaft with said second elongate member causes a deflection of said second elongate member resulting in a pivoting of said printhead base about said virtual pivot axis in a second direction different than said first direction.

19. The apparatus of claim 17, wherein said actuator comprises a rotary wheel having a plurality of teeth located around a periphery of said wheel.

20. The apparatus of claim 19, wherein said adjustment device further comprises a flexible arm connected to said device frame, said flexible arm including a detent protrusion which engages a valley between a pair of teeth of said plurality of teeth of said wheel to inhibit rotation of said threaded shaft, and wherein a deflection of said flexible arm disengages said detent protrusion from said valley to permit rotation of said threaded shaft.

21. A laser printhead skew adjustment device for use in a printhead assembly having at least a first flexible member, comprising:

a device frame;

a positioning member coupled to said device frame, said positioning member having a threaded bore;

a shaft having a threaded portion for cooperative rotatable engagement with said threaded bore, said shaft further having at least a first engagement end adapted for engaging said first flexible member;

an actuator located between said first engagement end and a second engagement end for effecting a rotation of said threaded shaft; and a limiting device for selectably engaging said actuator to selectably inhibit a rotation of said shaft.

22. The laser printhead skew adjustment device of claim 21, wherein said actuator comprises a wheel having a plurality of teeth formed around a periphery of said wheel.

23. The laser printhead skew adjustment device of claim 22, wherein said limiting device comprises a flexible arm having a protrusion for engaging a valley formed between two adjacent teeth of said plurality of teeth.

24. A method of correcting printhead skew in an apparatus having a machine frame unit to which a printhead having a printhead housing is mounted, comprising the steps of:

defining a desired scan path for said printhead;

identifying an actual scan path of said printhead;

determining an amount of skew between said desired scan path and said actual scan path;

providing an eccentric shaft which engages said machine frame unit and said printhead housing;

rotating said eccentric shaft to effect an initial positioning of said printhead housing with respect to said machine frame unit;

providing a plurality of fasteners to fixedly attach said printhead housing to said machine frame unit following said initial positioning; and providing a fine adjustment mechanism to effect a rotation of said printhead housing about a virtual pivot axis to provide a final positioning of said printhead after said printhead housing is fixedly attached to said machine frame unit.

25. The method of claim 24, wherein said fine adjustment mechanism effects an incremental rotation of said printhead about said virtual pivot axis.

26. The method of claim 24, wherein said printhead housing is configured to define a location of said virtual pivot axis.

27. The method of claim 24, further comprising the step of effecting said initial positioning of said printhead housing by rotating said printhead housing about an actual pivot axis.

28. The method of claim 27, wherein said printhead housing is configured to define a location of said virtual pivot axis which substantially corresponds to a location of said actual pivot axis.

29. An apparatus for mounting a laser printhead in an imaging apparatus, said imaging apparatus including a machine frame unit having a plurality of mounting locations with a corresponding plurality of mounting fasteners, said apparatus comprising:

a printhead base for mounting said laser printhead, said printhead base having a first end and a second end;

a first resilient elongate unit having a first proximal end and a first distal end, wherein said first proximal end is attached to said first end of said printhead base, said first resilient elongate unit including a first resilient elongate member, a second resilient elongate member spaced apart from said first resilient elongate member, a third resilient elongate member connected between said first resilient elongate member and said second resilient elongate member, and a mounting tab coupled to said third resilient elongate member, said mounting tab being adapted for attachment to a first mounting location of said plurality of mounting locations of said machine frame unit;

a second resilient elongate unit having a second proximal end and a second distal end, wherein said second proximal end is attached to said second end of said printhead base; and a mounting plate connected to said second resilient elongate unit, said mounting plate being adapted for attachment to at least a second mounting location of said plurality of mounting locations of said machine frame unit, wherein at least one of said first resilient elongate unit and said second resilient elongate unit is configured to channel thermal movement during thermal expansion and thermal retraction of said apparatus in directions toward and from, respectively, said mounting tab for deflective absorption of said thermal movement by said third resilient elongate member.

* * * * *